US005381565A

United States Patent [19]

Schmidt

[11] Patent Number: 5,381,565

[45] Date of Patent: Jan. 17, 1995

[54] BACK REST FOR A LIFTING APPARATUS

[75] Inventor: Peter Schmidt, Argenbühl/Eisenharz, Germany

[73] Assignee: Schmidt & Lenhardt GmbH & Co. oHG, Pau, Germany

[21] Appl. No.: 173,647

[22] Filed: Dec. 22, 1993

[30] Foreign Application Priority Data

Dec. 29, 1992 [EP] European Pat. Off. ..... 92122107

[51] Int. Cl.[6] ..... A47K 3/12

[52] U.S. Cl. ..... 4/560.1; 4/575.1; 5/634

[58] Field of Search ..... 4/560.1, 563.1, 566.1, 4/575.1, 667; 5/614, 615, 633, 634; 297/362.1, 362.11, 362.12, 362.13

[56] References Cited

U.S. PATENT DOCUMENTS

| | | | |
|---|---|---|---|
| 3,781,928 | 1/1974 | Swallert | 5/615 X |
| 3,931,653 | 1/1976 | Bien | 5/634 |
| 4,185,342 | 1/1980 | Young | 5/634 |
| 4,625,348 | 12/1986 | Renggli et al. | 5/614 |
| 4,660,234 | 4/1987 | Schmidt | 4/566.1 |
| 5,014,378 | 5/1991 | Sato | 5/615 X |

FOREIGN PATENT DOCUMENTS

| | | | |
|---|---|---|---|
| 3337536 | 5/1985 | Germany | 4/560.1 |

*Primary Examiner*—Robert M. Fetsuga
*Attorney, Agent, or Firm*—Notaro & Michalos

[57] ABSTRACT

A back rest (10) capable of being mounted on a lift platform of a lifting apparatus has a foot part (12) and, thereon, a slab (14) pivotable about a swivel axle (34), the slab (14) forming the back part. At the rear, there is a transverse supporting wall (44) moulded or attached to the slab (14) and spaced sufficiently apart from the swivel axle (34). Between the supporting wall (44) and the bottom (24) of the foot part (12), there is a transverse piece of hose (16) disposed parallel to the swivel axle (34) and closed at its ends, which is connected to the hydraulic-water system of the lifting apparatus via a manual control valve. When the piece of hose (16) is filled, the slab (14) is raised to an upright position even if the upper part of the user's body is applying a load to the slab (14). When hydraulic water is emptied out in a controlled way, the slab (14) can be adjusted in an infinitely variable manner, passing through various angles of inclination and reaching a position with a flatter angle of inclination, in which an attachment at the rear of the slab (14) comes to rest on the foot part (12).

5 Claims, 3 Drawing Sheets

BACK REST FOR A LIFTING APPARATUS

BACKGROUND OF THE INVENTION

The invention relates to a back rest for lifting apparatus useful for insertion in a bathtub, comprising a foot part capable of being mounted on a lift platform of the lifting apparatus and a slab, pivotably mounted on said foot part and forming a back part, together with an adjustment means with which to adjust the angle of inclination of the slab.

A back rest of this kind is known from U.S. Pat. No. 4,932,087. The adjustment means consists of a locking hinge arranged coaxially to the swivel axle. The angle of inclination of the slab can be adjusted very finely, but it is necessary to move the slab parallel to the direction of the swivel axle prior to adjusting the angle of inclination, in order to release the snap-in lock. Once the angle of inclination has been adjusted, the lock snaps in automatically thanks to a built-in spring, at least as long as there is no load on the back part. Since lifting apparatuses of this kind are frequently used by handicapped persons who do not have perfect control over their body movements, it is often problematic for the user to adjust the angle of inclination himself, firstly because the back part is difficult to move into the swivelling position when there is a load on it, and secondly because any supporting function is lost in said swivelling position, so that, under load, the back part jerks backwards. Even for a helper, it is often not easy to move the back part from a flatter angle of inclination to a steep angle when the user is applying a load to it.

SUMMARY OF THE INVENTION

The object of the invention is to provide a back rest for a lifting apparatus which makes it possible for either the user or a helper to adjust the angle of inclination without difficulty, even when there is a load imposed upon it.

This problem is solved in a back rest of the type described above by having a hollow body which is capable of being filled with water under pressure, said hollow body being made of a flexible, substantially non-stretch material, disposed on the foot part behind the slab, with the bottom pressing against the foot part and the top pressing against the rear of the slab or alternatively a projecting part extending from the slab towards the rear, in each case above the horizontal plane passing through the swivel bearing, and by having the hollow body connected pressure-tight, by means of a connecting hose, to a multi-path manual control valve.

Since the majority of lifting apparatuses in use today have a hydraulically operated lifting means, it is very easy to combine the hydraulic system of the operating means of the invention for adjusting the angle of inclination of the back part with the hydraulic-water run-off water system of the lifting apparatus. All that is needed is an additional manual control valve in order to connect the hollow body to the hydraulic feed line of the apparatus and thus to adjust the back part into a more upright position. The adjustment is infinitely variable and, if the flow cross-section in the connecting line or an inlet part of the hollow body is dimensioned appropriately, occurs sufficiently slowly to ensure that there is no risk to the handicapped person. It is particularly advantageous that the adjustment does not require the user or the operator to exert any force and that this adjustment also works perfectly even when a heavy load is applied to the back part. When the operator lets go of the lever of the manual control valve, the hydraulic supply to the hollow body is cut off. The back part then remains in the position it has reached at any particular time. In the other operating position of the manual control valve, the water flows out of the hollow body and into the bathtub, and the back part swivels backwards to a less sharp angle. Thanks to the selected diameter of the hose or, where applicable, by means of a built-in flow-restricting device, this movement likewise takes place slowly and in a controlled manner, so that the handicapped person does not lose his back support.

According to one embodiment of the invention, the hollow body consists of a folding bellows the two end plates of which swivel relative to one another. In the filled position, the bellows take the shape of a torus sector. The outer jacket line of the bellows is then several times the diametrically opposite inner jacket line. One end plate of the bellows is fixed to the foot part, and the top end plate is fixed to the rear of the back part.

An alternative embodiment according to the invention consists in the hollow body's consisting of a piece of hose closed at the end. According to a further development of this latter variant, the piece of hose is mounted in an essentially upright position. In this case, the two ends of the piece of hose are located in the longitudinally central plane of the back part, the lower end fitting being fastened to the foot part and the upper end fitting being fastened to the slab. In the position with a flatter angle of inclination, this piece of hose is folded approximately in the middle. When filled with water under pressure, the piece of hose stretches and, in so doing, swivels the back part slab into its upright position.

A preferred further variant consists in the piece of hose being disposed horizontally and extending approximately parallel to the swivel axle, preferably in a chamber on one of the parts of the back rest comprising the foot part and the slab, with at least the greater part of the length of the hose pressing against the foot part and the top. The chamber is preferably formed at the foot part and, in addition to the floor, has a rear wall and two side walls and preferably also a front partition, so that, when a load is imposed, the piece of hose can press with a positive fit against the rear wall. When the piece of hose is emptied, the front wall serves to keep it in position. This variant, with a transverse piece of hose, has the advantage that the foot part only needs to project backwards a short distance over the back part, as a result of which, when the back part is in its upright position, at which point it forms an angle of about 15° to the vertical, a perpendicular line drawn down from the upper edge of the back part would approximately intersect the rear end of the foot part.

Especially favourable lifting conditions are achieved if at the rear of the slab there is a supporting wall parallel to the swivel axle and spaced apart therefrom, against which the piece of hose presses, while remaining spaced apart from the slab at the rear.

In cross-section, the supporting wall will preferably have a concave arch on the bottom side, at least in the central portion, corresponding to the diameter of the piece of hose when filled. In this way, the bearing surface of the supporting wall is increased.

On the bottom side, the tangential plane of the supporting wall, forming a lever arm for the back-part slab, intersects at least approximately the axis of the swivel bearing. The supporting wall is thus directed essentially radially in relation to the swivel bearing axle. In the upright position of the back part, the supporting wall forms an angle of about 30° to about 40° to the horizontal. In the position with a flatter angle of inclination, said supporting wall extends approximately horizontally.

Yet another further development of the invention can be seen when the chamber is formed in the foot part and when said foot part has a vertical rear wall and likewise vertical side walls, disposed so that said side walls confine the chamber, and a box open at the bottom is moulded or attached to the rear of the slab in such a way that its downwardly pointing side walls and rear wall overlap those of the foot part, at least when the slab is in the position with the flatter angle of inclination. This overlap is preferably also present in the upright position, so that the piece of hose is not visible at any angle of inclination of the slab, thus providing it with good protection.

Finally there is also another embodiment, in which the slab has a wall at the rear forming a stop face spaced apart from the slab, said stop face resting on one of the upright walls of the foot part when the slab is in the position with the flatter angle of inclination. Experience has shown that a swivelling angle of 30° is completely sufficient for the back part, because the upright position can be fixed at 15° to the vertical. With an adjustment range of 30°, the back part then takes a 45° position in the position with the flatter angle of inclination. In this position, the slab is stopped mechanically at the foot part, so that letting more water out of the piece of hose no longer has any influence on the adjustment of the angle of inclination.

For ease of operation it is furthermore advantageous for a mechanical spring or gas spring to be disposed between the slab and the foot part, preferably concealed in the interior of the two interlocking chambers of the slab and foot part and ensuring that the slab is slightly biased in one of its two extreme positions. The slab is preferably drawn towards its position with a flatter angle of inclination, so that there is a defined initial position which also offers advantages such as ease of handling during transport.

According to one embodiment, the manual control valve is housed in a connecting line which can be attached to the piece of hose or the adjacent fitting by means of a rapid-action hose coupling. On the inlet side, the manual control valve can then be connected to the hydraulic system of the lifting apparatus via a section of connecting line, likewise by means of a rapid-action hose coupling. In this way, the back rest can be removed from the lifting apparatus and reconnected mechanically and hydraulically by hand with great ease. It is equally possible, however, to form a fixed attachment between the connecting hose with the manual control valve and the piece of hose of the back rest. According to one embodiment, the manual control valve can have mechanical plug-in feet which can be inserted into corresponding holes in the lift platform. Since it is possible to remove the back rest, the lifting apparatus can also be operated without the rest. The back rest can also be supplied subsequently as an accessory.

The invention will now be described in more detail, by reference to the drawings, which show one embodiment.

DETAILED DESCRIPTION

Figure 1:
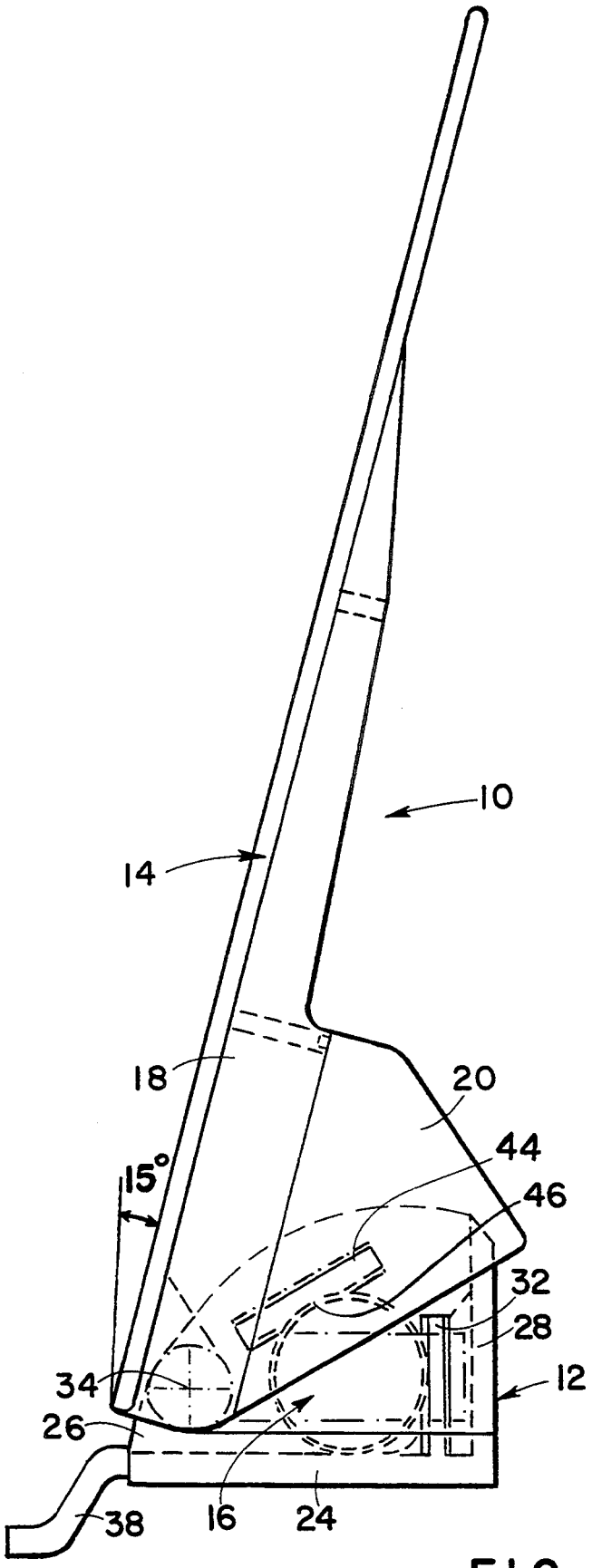
FIG. 1 is a side view of the novel back rest in an upright position.

The back rest 10 consists of a foot part 12 and a slab 14 forming a back part, together with a piece of hose 16, closed at the end. At the rear, the slab 14 has parallel reinforcing walls 18 running from bottom to top, with two side walls 20 connected to them in the lower part, said side walls 20 being connected together by a rear wall 22 (cf. FIG. 2) and forming a box open at the bottom.

Figure 3:
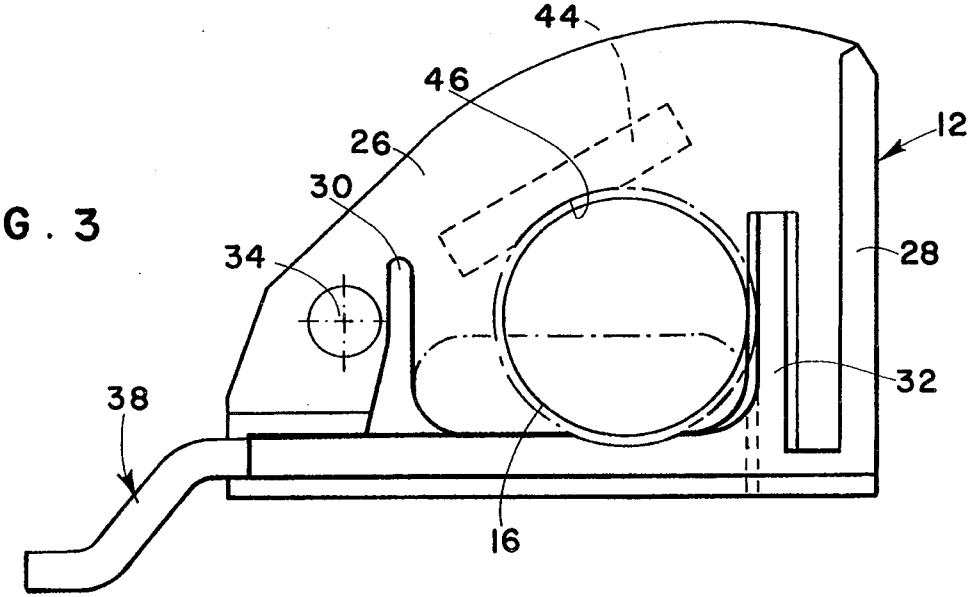
FIG. 3 is a side view of the foot part of the back rest with a piece of hose inserted.

The foot part 12 consists of a bottom plate 24, two side walls 26 and a rear wall 28. Together with the bottom 24 and the rear wall 28, the side walls 26 form a housing in which the piece of hose 16 is received. In order to keep the piece of hose 16 in position, there are also provided an upright front wall 30 and a rear partition 32, as shown in FIG. 3. The two walls 30 and 32 position the piece of hose 16. Between the two side walls 26, in the front region of the foot part 12 and a certain distance above the lower side of the foot part, there is a swivel axle 34 protruding outwards from the two side walls 26 and engaging in corresponding holes drilled in the ribs 18 of the slab 14 and/or further holes drilled in the side walls 20 of the slab 14. In this way, the slab 14 is pivotably mounted to the foot part 12.

Figure 2:
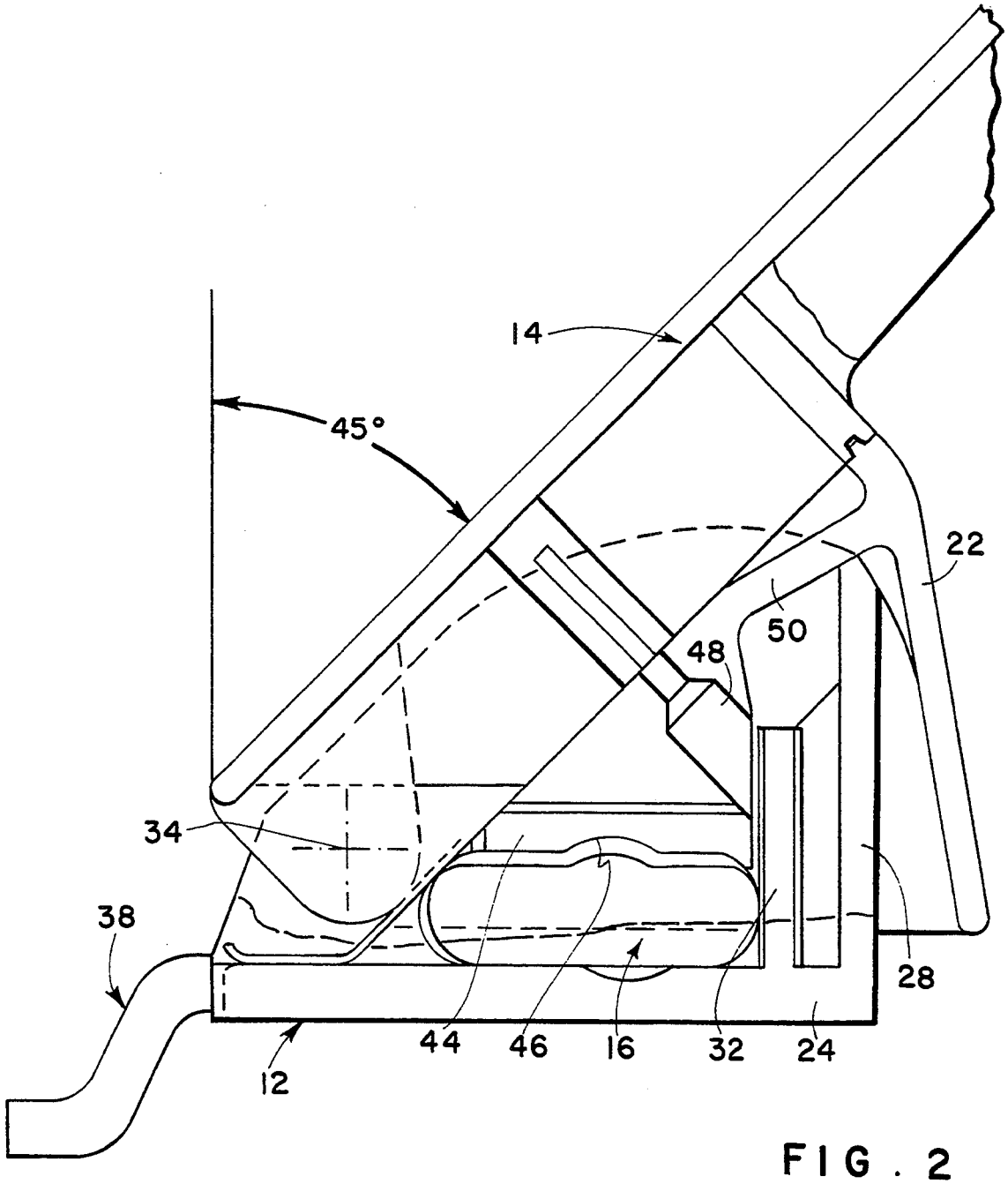
FIG. 2 is a side view of the back rest on a larger scale, but in the position with the flatter angle of inclination.

Both in the upright position (FIG. 1) of the slab 14 and, a fortiori, in the position with the flatter angle of inclination according to FIG. 2, the box open at the bottom—formed by the rear wall 22 and the side walls 20 with the slab itself—overlaps the housing of the foot part 12, which is formed by the side walls 26 and the rear wall 28 and is open at the top. The chamber formed in the foot part 12 for the piece of hose 16 is therefore closed in all the operating positions of the back rest 10. The bottom 24 of the foot part 12 has a flat lower surface, which is intended for resting on a lift platform of a lifting apparatus. The bottom 24 further has two lateral edge reinforcements in which parallel channels 36 are formed, with metal rods 38 inserted in them, the front ends of said metal rods 38 projecting out of the foot part 12, and the projecting ends being bent at right angles, as shown in FIGS. 1, 2 and 3. These multiple right-angled bends provide a simple means of attaching the back rest 10 to the lift platform of the lifting apparatus, namely by inserting the ends, bent at right angles, of the rods 38 from above into corresponding holes in the lift platform. The short, straight front end of each rod 38 then engages beneath the lift platform of the lifting apparatus when the foot part 12 of the back rest is resting on said lift platform.

Figure 4:
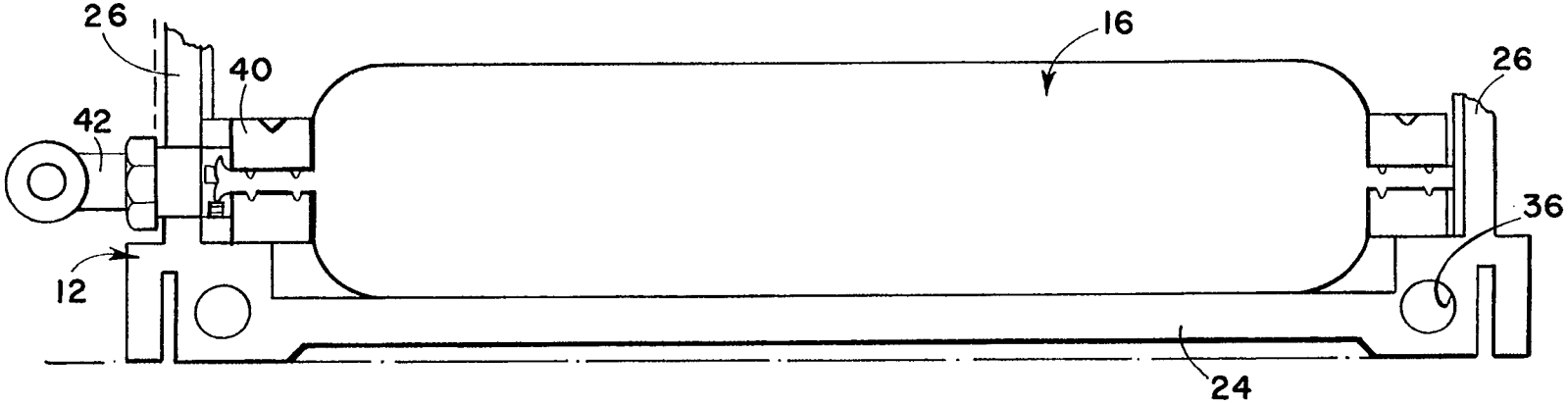
FIG. 4 is a rear view of the foot part with a piece of hose inserted, and with the rear wall of the foot part omitted.

The piece of hose 16 lies transverse to the longitudinal direction of the back rest 10 and the lifting apparatus. Its two ends are connected pressure-tight by means of clamps 40. Two clamps 40 in each case are mortise and tenoned and/or riveted together, including the edge portion of the piece of hose. The total length of the piece of hose 16 with the pairs of clamps at both ends is equal to the clear width of the foot part 12, measured between the two side walls 26. In the middle of the end of the piece of hose shown on the left in FIG. 4, a tube with a comparatively small cross-section is also pressed in, which is connected to a fitting 42 that belongs to a connecting line by means of which the piece of hose 16 is connected to a manual control valve.

Between the side walls 20 of the slab 14 forming the back part, there is a supporting wall 44 the tangential plane of which on the bottom side intercepts the axis of the swivel bearing 34. This plane forms an angle of about 45° to the plane of the slab 14, and the supporting wall 44 is spaced sufficiently far apart from the rear surface of the slab 14 and the swivel bearing 34 so that said supporting wall 44 can cooperate effectively with the piece of hose 16 to swivel the slab 14 with sufficient leverage even when a powerful counter-force is applied. As FIGS. 1 and 3 demonstrate, the centre portion of the supporting wall 44 has a concave arch on the bottom side. This concave arch 46 extends over the entire length of the supporting wall 44 measured in the direction of the swivel axle. This concave arch 46 is adapted to the diameter of the piece of hose 16 when filled, thus creating a wide bearing surface.

When filled with hydraulic water, the piece of hose 16 takes on a cylindrical shape and presses both against the bottom plate 24 and against the rear partition 32 of the foot part 12, forcing the slab 14 into an upright position by means of the supporting wall 44. In said upright position, the slab 14 forms an angle of about 15° to the vertical. If the hydraulic water is emptied from the piece of hose 16, the slab 14 slowly swivels backwards, causing the piece of hose 16 to become increasingly flatter. By letting go of the manual control valve lever, it is possible to fix the slab 14 at any desired angle of inclination. The full swivelling angle in this embodiment is 30°. The slab 14 then forms an angle of 45° to the vertical. This position is shown in FIG. 2. In this position with the flatter angle of inclination, the supporting wall 44 is essentially horizontal. The same applies to the bottom edges of the side walls 20 of the slab 14, and a reinforcing wall 50 of the mount 14 is resting on the upper edge of the rear wall 28 of the foot part 12. When the slab 14 is in this position, there is no load imposed on the piece of hose 16, since the slab 14 is supported mechanically by the foot part 12.

A gas tension spring 48 biases the slab 14 in the direction of this position with the flatter angle of inclination (cf. FIG. 2), so that the slab 14 and foot part 12 cannot be freely swivelled relative to one another, which would be problematic during transport, for example. Furthermore, this tension spring 48 also secures the slab 14 in the intermediate positions determined by the amount of hydraulic water in the piece of hose 16.

I claim:

1. A back rest for mounting on a platform of a lifting apparatus insertable in a bathtub, comprising a foot part, a slab pivotably mounted on said foot part about a swivel axis, a chamber formed between the foot part and the slab, a piece of hose made of a flexible, substantially non-stretch material, clamp means for closing the ends of the hose, said piece of hose disposed horizontally in said chamber behind the slab and extending approximately parallel to the swivel axis, a projecting part extending from a rear end of said slab, at least a substantial portion of the length of the piece of hose having a bottom surface pressing against the foot part and a top surface pressing against said projecting part, the top surface pressing against said projecting part at a level above said swivel axis, and fitting means connected to the piece of hose for filling the piece of hose with pressurized water to adjust the inclination of the slab.

2. The back rest according to claim 1, wherein the projecting part forms a supporting wall extending parallel to the swivel axis and spaced apart therefrom.

3. The back rest according to claim 2, wherein the supporting wall has a concave arch at a bottom side of the supporting wall corresponding to a diameter of the piece of hose when filled with pressurized water.

4. The back rest according to claim 2, wherein a bottom surface of the supporting wall has a tangential plane which intersects approximately with the swivel axis.

5. The back rest according to claim 1, wherein the chamber is formed by a vertical rear wall and vertical side walls extending from the foot part, and, an open box at the rear of the slab having downwardly extending side walls and a rear wall which overlap the vertical side walls and rear walls of the foot part respectively when the slab is in a position having a relatively small angle of inclination.

* * * * *